US006734753B2

(12) United States Patent
Kawanami et al.

(10) Patent No.: US 6,734,753 B2
(45) Date of Patent: May 11, 2004

(54) NONRECIPROCAL CIRCUIT ELEMENT AND COMMUNICATION DEVICE

(75) Inventors: Takashi Kawanami, Ishikawa-ken (JP); Takashi Hasegawa, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 52 days.

(21) Appl. No.: 10/253,591

(22) Filed: Sep. 25, 2002

(65) Prior Publication Data

US 2003/0067365 A1 Apr. 10, 2003

(30) Foreign Application Priority Data

Oct. 4, 2001 (JP) ..... 2001-309113

(51) Int. Cl.[7] ..... H01P 1/36
(52) U.S. Cl. ..... 333/24.2; 333/1.1
(58) Field of Search ..... 333/1.1, 24.2; H01P 1/36, 1/387, 1/32, 1/383, 1/38

(56) References Cited

FOREIGN PATENT DOCUMENTS

| | | | |
|---|---|---|---|
| JP | 408008613 A | * | 1/1996 |
| JP | 11-097908 | | 4/1999 |
| JP | 2001168604 A | * | 6/2001 |
| WO | WO 01/33665 A1 | | 5/2001 |
| WO | WO 02/078123 | | 10/2002 |

* cited by examiner

*Primary Examiner*—Benny Lee
*Assistant Examiner*—Stephen E. Jones
(74) *Attorney, Agent, or Firm*—Keating & Bennett, LLP

(57) ABSTRACT

A nonreciprocal circuit element includes a lower metallic case, a resin terminal case, a ferrite, a center conductor, an upper metallic case, a permanent magnet, matching capacitor elements and other elements. The center conductor includes center electrodes each having two lines extending from a ground electrode. The height of the top surface of each of the matching capacitor elements is lower than that of the top surface of the ferrite. Simultaneously, in at least one of the center electrodes disposed on the side surface of the ferrite, the edge thereof is located closer to the capacitor electrode of the corresponding matching capacitor element than the other edge thereof. Also, in a direction that is substantially perpendicular to the height direction of the ferrite, the bottom surface of the one edge is located farther away from the capacitor electrode of the corresponding matching capacitor element than the top surface thereof.

20 Claims, 11 Drawing Sheets

NONRECIPROCAL CIRCUIT ELEMENT AND COMMUNICATION DEVICE

BACKGROUND OF THE INVENTION

1. Field of the Invention

The present invention relates to a nonreciprocal circuit element, such as an isolator and a circulator, for use in, for example, a microwave band, and relates to a communication device including the same.

2. Description of the Related Art

As a concentrated constant type isolator used for a mobile communication device such as a portable telephone, an isolator disclosed in Japanese Unexamined Patent Application Publication No. 11-97908 is known. As shown in FIG. 17, this isolator 200 substantially includes a resin terminal case 203, a lower metallic case 208, and an upper metallic case 204. These elements accommodate therein a permanent magnet 209, a center electrode assembly 213, matching capacitor elements C, and a resistance element R. The center electrode assembly 213 includes a center conductor 220 constituted of center electrodes 221 to 223 and a ground electrode 224, and a ferrite 230.

Windows 203*b* for accommodating the matching capacitor elements C formed in the resin terminal case 203, and an insertion hole 203*a* for accommodating the center electrode assembly 213 are formed at positions adjacent to each other. The side surface of the insertion hole 203*a* and that of each of the windows 203*b* communicate with each other via grooves 203*c*.

As shown in FIG. 18, the center conductor 220 is arranged so that the center electrodes 221 to 223 and the ground electrode 224 thereof are integral with each other. The center electrodes 221 to 223 are each constituted of two parallel lines. These lines are each connected to the ground electrode 224 in a substantially linear configuration.

As shown in FIG. 17, the center electrode assembly 213 is obtained by the winding center conductor 220 around the ferrite 230. Specifically, the ferrite 230 is disposed on the ground electrode 224, and as shown in FIG. 19, the center electrodes 221 to 223 are folded substantially perpendicularly to the bottom surface of the ferrite 230. Furthermore, the center electrodes 221 to 223 are sequentially folded along the side surface and the top surface of the ferrite 230, and are placed on the top surface of the ferrite 230 with insulating sheets therebetween, thereby obtaining the center electrode assembly 213.

The center electrode assembly 213, the matching capacitor elements C and others are accommodated in the resin terminal case 203. At this time, since the insertion hole 203*a* and the windows 203*b* of the resin terminal case 203 communicate with each other via the grooves 203*c*, the center electrode 222 disposed on the side surface of the ferrite 230 is situated at a position adjacent to the hot-side electrode disposed over the entire top surface of a corresponding matching capacitor element C. Similarly, the center electrode 221 and another corresponding matching capacitor element C are also situated at positions adjacent to each other, although they are not shown in FIG. 19.

With the demand for miniaturization of mobile communication devices, the isolator 200 used in such communication devices has also been required to be miniaturized. As a result, the distance between the center electrode assembly 213 and the capacitor electrode of each of the matching capacitor elements C has been reduced. However, the reduction in distance between the center electrode assembly 213 and each of the matching capacitor elements C may cause a problem of short-circuiting. Because, due to displacement of the center electrode assembly 213 and/or at least one of the matching capacitor elements C, e.g. the edge 222*a* of the center electrode 222 and the capacitor electrode of the corresponding matching capacitor element C may contact each other, or solder balls adhered to the capacitor electrode of the corresponding matching capacitor element C may contact the edge 222*a* of the center electrode 222.

SUMMARY OF THE INVENTION

In order to overcome the problems described above, preferred embodiments of the present invention provide compact and a highly reliable nonreciprocal circuit element and communication device.

According to a preferred embodiment of the present invention, a nonreciprocal circuit element includes a permanent magnet, a ferrite having a first main surface to which a DC magnetic field is applied by the permanent magnet, a second main surface opposed to the first main surface, and a side surface substantially perpendicularly intersecting the first and second main surfaces, a center conductor having a ground electrode disposed on the second main surface of the ferrite, and a plurality of center electrodes that extend from the ground electrode and that are disposed so as to intersect each other at a predetermined angle on the first main surface of the ferrite through the side surface of the ferrite, matching capacitor elements that are disposed adjacent to a center electrode assembly including the ferrite and the center conductor, and that are electrically connected to the respective center electrodes, and a metallic member that accommodates the permanent magnet and the center electrode assembly. In this nonreciprocal circuit element, the height of the top surface of each of the matching capacitor elements is lower than that of the first main surface of the ferrite. Simultaneously, on the side surface of the ferrite, one edge of at least one of the center electrodes is located closer to the electrode of the corresponding matching capacitor element than the other edge of the center electrode. Furthermore, in a direction that is substantially perpendicular to the height direction of the ferrite, the second main surface side portion of the one edge of the center electrode is located farther from the electrode of the corresponding matching capacitor element than the first main surface side portion of the one edge of the center electrode.

Another preferred embodiment of the present invention, a nonreciprocal circuit element includes a permanent magnet, a ferrite having a first main surface to which a DC magnetic field is applied by the permanent magnet, a second main surface opposed to the first main surface, and a side surface substantially perpendicularly intersecting the first and second main surfaces, a center conductor having a ground electrode disposed on the second main surface of the ferrite, and a plurality of center electrodes that extend from the ground electrode and that are disposed so as to intersect each other at a predetermined angle on the first main surface of the ferrite through the side surface of the ferrite, matching capacitor elements that are disposed adjacent to a center electrode assembly including the ferrite and the center conductor, and that are electrically connected to the respective center electrodes, and a metallic member that accommodates the permanent magnet and the center electrode assembly. In this nonreciprocal circuit element, the height of the top surface of each of the matching capacitor elements is lower than that of the first main surface of the ferrite. Simultaneously, on the side surface of the ferrite, one edge of at least one of the center electrodes is located closer to the electrode of the corresponding matching capacitor element than the other edge of the center electrode. Furthermore, in a direction that is substantially perpendicular to the height direction of the ferrite, the central portion between the first main surface side portion and the second main surface side portion of the one edge of the center electrode is located farther from the hot-side capacitor electrode of the corresponding matching capacitor element than either of the first main surface side portion and the second main surface side portion of the one edge of the center electrode. Herein, each of the center electrodes may be branched into a plurality of lines on the side surface of the ferrite, and the branched lines may be disposed on the first main surface of the ferrite.

With these arrangements, the plurality of center electrodes disposed on the first main surface does not need to change the intersecting angle between them, thereby preventing the electrical characteristic of the nonreciprocal circuit element from being deteriorated. On the other hand, the center electrodes disposed on the side surface of the ferrite are each arranged so that the electrode width on the side where a corresponding matching capacitor element is disposed, that is, the electrode width on the second main surface side portion of the ferrite is reduced into a taper shape, or the central portion thereof between the first main surface side and the second main surface side is formed into a substantially V-shaped configuration, thereby locating the center electrode farther away from the electrode of the corresponding matching capacitor element than in the related case. This prevents the center electrodes disposed on the side surface of the ferrite and the electrodes of the respective matching capacitor elements from electrically connecting with each other.

Preferably, the shapes of the center electrode portions disposed on the side surface of the ferrite are each bilaterally symmetrical. Thereby, the bending stress to be applied to the center electrodes is uniformly applied in the width directions of the center electrodes, so that the center electrodes are correctly disposed on the first main surface through the side surface of the ferrite.

It is preferable that a nonreciprocal circuit element according to preferred embodiments of the present invention further includes a resin terminal member having a concave portion for accommodating the center electrode assembly and the matching capacitor elements. It is also preferable that each of the center electrodes disposed on the side surface of the ferrite be arranged so that the second main surface side portion thereof has a taper width that is narrower than the taper width of the first main surface side portion thereof, and that grooves each fitted to the taper shape of the center electrode are provided in the side wall of the concave portion of the resin terminal member. This improves the efficiency of work of inserting the ferrite and the center electrodes into the concave portion in the resin terminal case.

The present invention also provides a communication device that allows the implementation of a compact and high-reliability communication device by including the above-described nonreciprocal circuit element according to various other preferred embodiments of the present invention.

The above and other elements, characteristics, features, and advantages of the present invention will become clear from the following detailed description of the preferred embodiments of the invention in conjunction with the accompanying drawings.

DETAILED DESCRIPTION OF PREFERRED EMBODIMENTS

Figure 1:
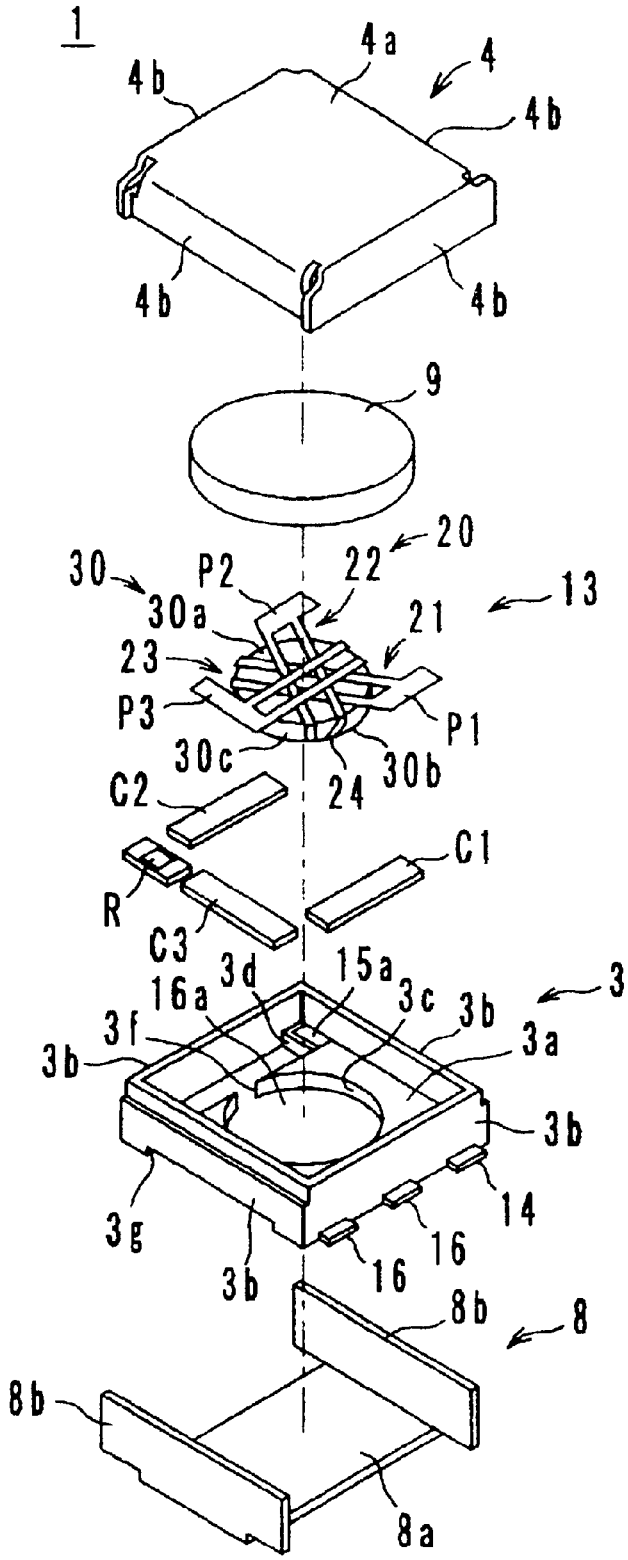
FIG. 1 is a perspective exploded view showing a first preferred embodiment of a nonreciprocal circuit element according to the present invention.

Hereinafter, preferred embodiments of a nonreciprocal circuit element and a communication device according to the present invention will be described with reference to the accompanying drawings. In these preferred embodiments, the same reference numerals are used to designate the same components and portions, and repeated description thereof is omitted.

FIG. 1 is a perspective exploded view showing a preferred embodiment of a nonreciprocal circuit element according to the present invention. Referring to FIG. 1, the concentrated constant type isolator 1 preferably includes a lower metallic case 8, a resin terminal case 3, a center electrode assembly 13, an upper metallic case 4, a permanent magnet 9, a resistor element R, matching capacitor elements C1 to C3 and other elements.

The upper metallic case 4 preferably has a substantially rectangular shape in a plan view, and has a top wall 4*a* and four side walls 4*b*. The lower metallic case 8 has a bottom wall 8*a* and right and left side walls 8*b*. The upper metallic case 4 and the lower metallic case 8 are preferably made by stamping a thin plate constituted of material including iron as a main constituent, and plating the stamped plate with copper or silver after having applied bending processes to it.

Figure 2:
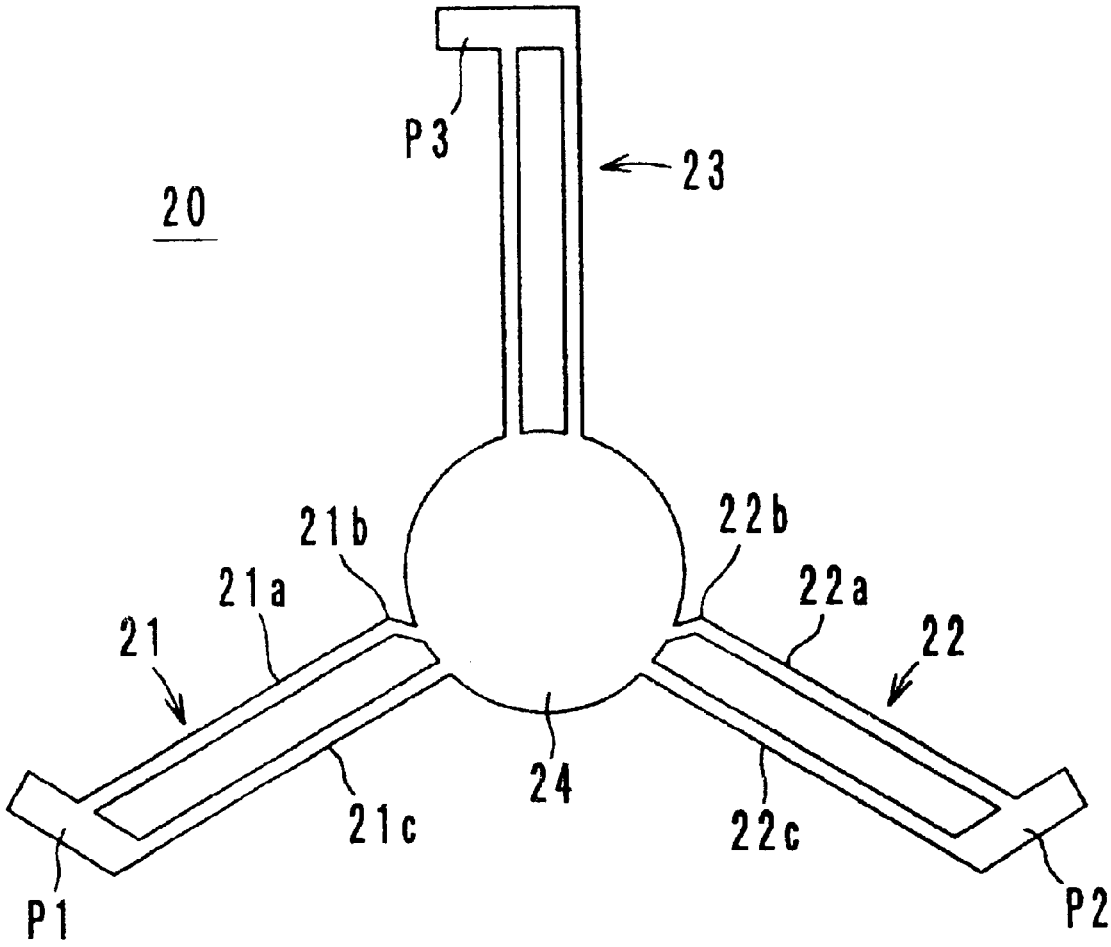
FIG. 2 is a developed view showing the center conductor shown in FIG. 1.

The center electrode assembly 13 includes a disk shaped microwave ferrite 30, a center conductor 20 and other elements. As shown in FIG. 2, the center conductor 20 includes a substantially circular ground electrode 24 and center electrodes 21 to 23 radially extending from the ground electrode 24, and the end portions of the center electrodes 21 to 23 are designated as ports P1 to P3, respectively. Each of the center electrodes 21 to 23 preferably includes two lines. The center electrode 23 side portions of the edges of the center electrodes 21 and 22 are designated as edge 21*a* and 22*a*, respectively. The ground electrode 24 side portions of the center electrodes 21 and 22 have respectively corner portions 21*b* and 22*b* so that one line of each of the center electrodes 21 and 22 approaches the other line thereof. As described later, the edges 21*a* and 22*a* of the center electrodes 21 and 22 approach the hot-side capacitor electrodes 27 of the matching capacitor elements C1 and C2, respectively. The center conductor 20 preferably is integrally formed by stamping a thin metallic film or by etching it.

The center electrode assembly 13 is assembled, for example, by the following procedure. First, the ferrite 30 is placed on the ground electrode 24. Then, the center electrode 21 is wound upon the top surface 30*a* of the ferrite 30, and an insulating sheet (not shown) is placed thereon. Furthermore, the center electrode 22, an insulating sheet, the center electrode 23, and an insulating sheet are stacked in this order, and thereby the center electrodes 22 and 23 are wound around the ferrite 39. The insulating sheets are stacked between the center electrodes 21 to 23 in order to prevent short circuits between the center electrodes 21 to 23.

In this manner, the center electrode assembly 13 shown in FIG. 1 is obtained. The center electrode assembly 13 is disposed so that the center electrodes 21 to 23 intersect each other at an angle of substantially 120 degrees. The center electrode 21 to 23 horizontally lead out the ports P1 to P3 at first side ends thereof, respectively. Also, the corner portions 21*b* and 22*b* that the first-side lines of the center electrodes 21 and 22 respectively have, are located on the side surface 30*c* of the ferrite 30.

The resin terminal case 3 has a bottom wall 3*a* and four side walls 3*b*. A substantially circular insertion hole 3*c* is formed at the approximately central portion of the bottom wall 3*a*, and around the insertion hole 3*c*, there are provided substantially rectangular windows 3*d* for accommodating the matching capacitor elements C1 to C3, and a substantially rectangular window 3*e* for accommodating the resistor element R. In order to reduce the size of the isolator 1, the windows 3*d* are formed at positions close to the insertion hole 3*c*, and the side surface of the insertion hole 3*c* and the side surface of each of the windows 3*d* are communicated with each other by grooves 3*f*. Also, a notch 3*g* for being offset by the bottom wall 8*a* of the lower metallic case 8 is formed under the bottom wall 3*a* of the resin terminal case 3.

In the resin terminal case 3, a surface-mount input terminal 14, a surface-mount output terminal 15, and a surface-mount ground terminals 16 are formed. The surface-mount input terminal 14 is arranged so that one end thereof is exposed on the outside surface of the side wall 3*b*, and that the other end thereof is exposed on the inside surface of the bottom wall 3*a*, thereby forming an input lead-out electrode 14*a* (see FIG. 3). On the other hand, the surface-mount output terminal 15 is arranged so that one end thereof is exposed on the outside surface of the side wall 3*b*, and that the other end thereof is exposed on the inside surface of the bottom wall 3*a*, thereby forming an output lead-out electrode 15*a*. The surface-mount ground terminals 16 extend from a ground electrode plate 17 (see FIG. 4) integrally formed on the bottom wall 3*a* of the resin terminal case 3, and two of them are lead out from each of the side walls 3*b* toward the outside. The ground electrode plate 17 is exposed at the substantially circular insertion hole 3*c* and the substantially rectangular windows 3*d*, and the exposed portion is used as a ground lead-out electrode 16*a*. Since the ground electrode plate 17 is integral with the surface-mount ground terminals 16, the ground potential of the ground electrode plate 17 can be reduced. This makes it possible to prevent and eliminate stray inductances, which do not contribute to the operation of the isolator 1, and to provide the isolator 1 with a wide band high-frequency characteristic.

The terminals 14 to 16, the ground electrode plate 17, and the electrodes 14*a* to 16*a* of the resin terminal case 3, are preferably formed of the same material and plated with the same plating treatment. Forming the terminals 14 to 16, the ground electrode plate 17, and the electrodes 14*a* to 16*a* using the same material allows, by making use of a long lead frame, the automation of the manufacturing of the resin terminal case 3 by an insert molding method and facilitates the treatment thereof during manufacturing. Specifically, the terminals 14 to 16, the ground electrode plate 17, and the electrodes 14*a* to 16*a* that have been integrated into one piece on the lead frame, are insert-molded to form resin terminal cases 3. Thereafter, individual resin terminal cases 3 are separated from the hoop portions of the lead frame to provide the individual resin terminal cases 3. It is therefore possible to inexpensively mass-produce the resin terminal cases 3, and to securely fix the terminals 14 to 16, the ground electrode plate 17, and the electrodes 14*a* to 16*a* to the resin terminal cases 3. In addition, since the terminals 14 to 16, the ground electrode plate 17, and the electrodes 14*a* to 16*a* can be produced as a one piece component, the cost of the isolator 1 is greatly reduced.

As a material for the resin terminal cases 3, for example, a liquid crystal polymer, polyphenylene sulfide, or polyether ether ketone is preferably used. These materials have high heat resistance and low loss characteristic in a microwave band (UHF band to SHF band) in which the isolator 1 is used.

As a material for the terminals 14 to 16, the ground electrode plate 17, and the electrodes 14*a* to 16*a*, iron, brass, or phosphor bronze, which is easily workable and inexpensive, is preferably used. When a magnetic material such as iron is used, the magnetic resistance of a magnetic circuit can be reduced, so that the thicknesses of the upper metallic case 4 and the lower metallic case 8 and the thickness of the permanent magnet can be reduced, resulting in a miniaturized isolator 1.

The terminals 14 to 16, the ground electrode plate 17, and the electrodes 14*a* to 16*a* are subjected to foundation plating with copper (the representative plating thickness: about 0.1 $\mu$m to about 1 $\mu$m), and over the surfaces thereof, silver plating is performed (the representative plating thickness: about 1 μm to about 10 μm). The silver plating has a high electrical conductivity. Furthermore, the silver plating has an effect of reducing the insertion loss of the isolator 1, and an anti-rust effect, as well as an effect of improving the wettability of solder. On the other hand, the copper plating has an effect of enhancing the adhesion strength between the silver plating and the matrix. Since the high frequency current by which the isolator 1 operates flows concentratingly on the surface portions of the terminals 14 to 16, the ground electrode plate 17 and the like, due to the skin effect, the film thickness of the silver plating is set in consideration of the skin depth at the center frequency of a pass band (microwave band). In the first preferred embodiment of the present invention, the film thickness of the copper foundation plating is preferably about 1 μm, and that of the silver plating is preferably about 3 μm. Here, nickel foundation plating or other suitable material or process may also be used instead of the copper foundation plating.

Figure 4:
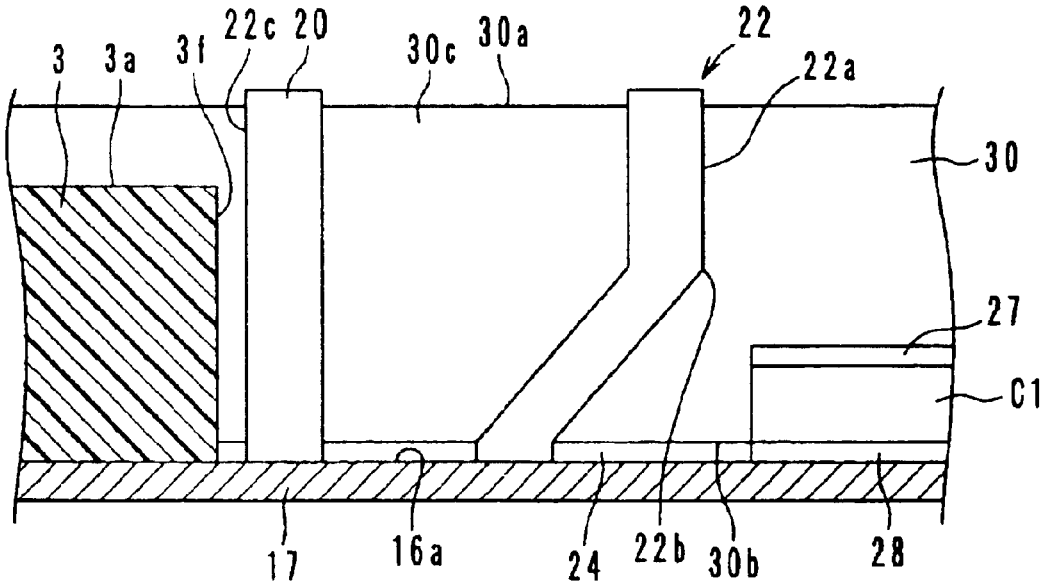
FIG. 4 is a vertical sectional view showing the nonreciprocal circuit element shown in FIG. 3.

In each of the matching capacitor elements C1 to C3, the hot-side capacitor electrode 27 is disposed over the entire top surface thereof, while a cold-side capacitor electrode 28 is disposed over the entire bottom surface thereof (see FIG. 4). The thickness of each of the matching capacitor elements C1 to C3 is preferably less than the thickness of the ferrite 30, i.e., the distance from the top surface 30*a* to the lower surface 30*b* thereof.

The resistor element R is obtained by forming a ground-side terminal electrode and a hot-side terminal electrode on opposite ends of an insulating substrate by a thick film printing method or other suitable process, and by disposing a resistor between these two electrodes.

The above-described components are assembled in the following manner. First, the bottom wall 8*a* of the lower metallic case 8 is caused to offset the notch 3*g* of the resin terminal case 3, and the lower metallic case 8 is electrically connected to the surface-mount ground terminal 16 through the ground electrode plate 17.

Figure 3:
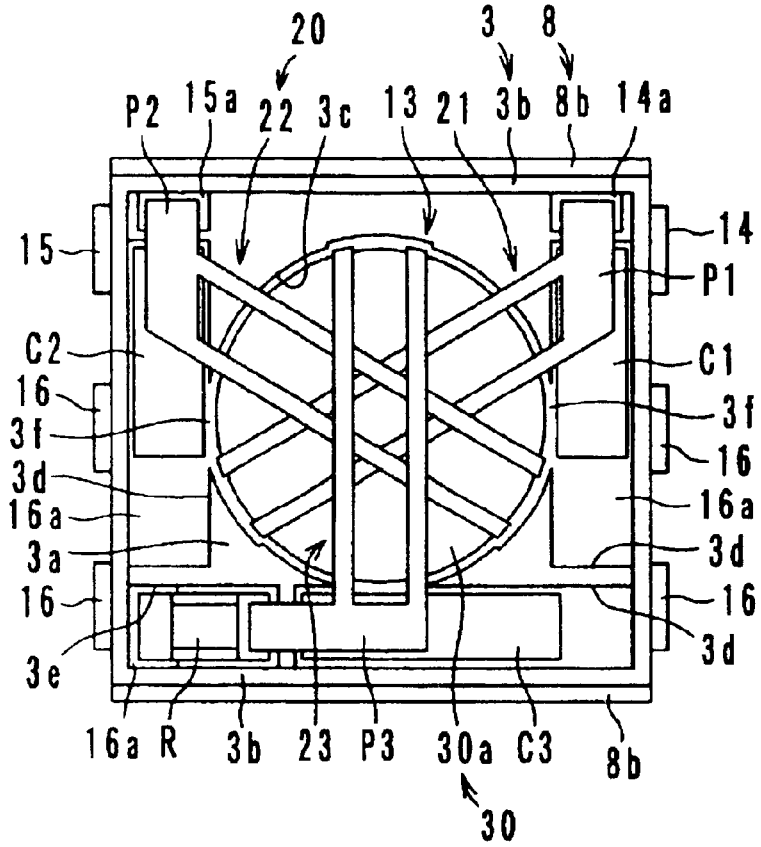
FIG. 3 is an inside plan view showing the nonreciprocal circuit element shown in FIG. 1.

Then, as shown in FIG. 3, the matching capacitor elements C1 to C3 and the resistor element R are respectively accommodated in the windows 3*d* and the window 3*e* of the resin terminal case 3, and the center electrode assembly 13 is accommodated in the insertion hole 3*c* of the resin terminal case 3. The ground electrode 24 disposed on the bottom surface 30*b* of the ferrite 30 is connected to the ground lead-out electrode 16*a* through the insertion hole 3*c* formed in the bottom wall 3*a* of the resin terminal case 3, and is grounded.

At this time, the hot-side terminal electrode of the resistor element R is connected to the hot-side capacitor electrode 27 of the matching capacitor element C3 through the port P3, which is the end portion of the center electrode 23. On the other hand, the ground-side terminal electrode of the resistor element R is connected to the ground lead-out electrode 16*a* of the ground electrode plate 17, which is exposed at the window 3*d* of the matching capacitor element C3. The hot-side capacitor electrodes 27 of the matching capacitor element C1 to C3 are connected to the ports P1 to P3, respectively. On the other hand, the cold-side terminal electrodes 28 of the matching capacitor elements C1 to C3 are connected to the respective ground lead-out electrodes 16*a* of the ground electrode plate 17. Since the ground lead-out electrodes 16*a* are electrically connected to the surface-mount ground terminal 16, the matching capacitor element C3 and the resistor element R are electrically parallelly connected between the port P3 of the center electrode 23 and the surface-mount ground terminal 16 (see FIG. 6). Meanwhile, connection work with respect to the hot-side capacitor electrode 27, the ground lead-out electrode 16*a*, the bottom wall 8*a* or the like is performed by a method such as solder reflow or other suitable method.

As shown in FIG. 4, the center electrode 22 is arranged so as to circumvent the capacitor electrode 27 of the matching capacitor element C1. Specifically, the height of the top surface of the matching, capacitor element C1 is located lower than that of the top surface 30*a* of the ferrite 30, and simultaneously, in the center electrode 22 disposed on the side surface 30*c* of the ferrite 30, one edge 22*a* of the center electrodes 22 is located closer to the capacitor electrode 27 of the matching capacitor element C1 than the other edge 22*c* of the center electrode 22. Moreover, in the direction that is substantially perpendicular to the height direction of the ferrite 30, the bottom surface 30*b* side portion of the edge 22*a* of the center electrode 22 is located farther from the capacitor electrode 27 of the matching capacitor element C1 than the top surface 30*a* side portion of the edge 22*a* of the center electrode 22.

Therefore, the distance between the center electrode 22 and the hot-side capacitor electrode 27 of the matching capacitor element C1 becomes larger than the distance between the center electrode 222 and the capacitor electrode of the matching capacitor element C in the related isolator 200. As a result, even if the center electrode assembly 13 and/or the matching capacitor C1 experience displacement, or solder balls adhere to the hot-side capacitor electrode 27, the center electrode 22 and the capacitor electrode 27 of the matching capacitor C1 are prevented from short-circuiting therebetween, as compared with the case of the related isolator 200. This significantly improves the electrical stability of preferred embodiments of the present invention. The same goes for the relationship between the center electrode 21 and the matching capacitor element C2.

The upper metallic case 4 is mounted on the lower metallic case 8. The permanent magnet 9 is disposed on the bottom side of the top wall 4*a* of the upper metallic case 4. The permanent magnet 9 applies a DC magnetic field to the ferrite 30 of the center electrode assembly 13. The side wall 8*b* of the lower metallic case 8 and the side wall 4*b* of the upper metallic case 4 are electrically connected by a method such as a solder reflow, whereby together they constitute the metallic case, and a magnetic circuit, as well as together serve as a yoke. Also, since the lower metallic case 8 is soldered to the ground lead-out electrode 16*a* over a wide area, the ground potential of the cases 4 and 8 is greatly reduced, thereby inhibiting the leakage of high frequency electromagnetic fields, which adversely affect other electronic components (i.e., other electronic components of a communication device including the isolator 1).

Figure 5:
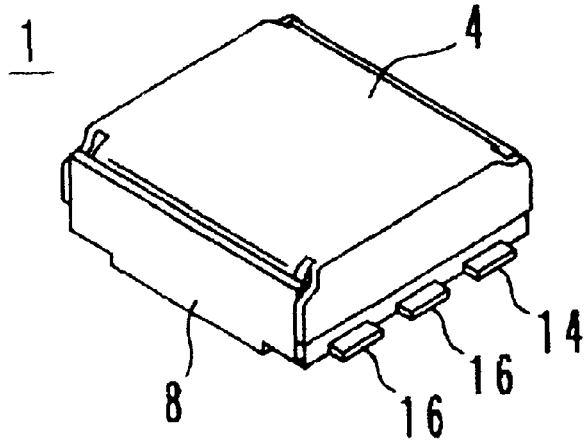
FIG. 5 is a perspective external view showing the nonreciprocal circuit element shown in FIG. 1, after having been completely assembled.
Figure 6:
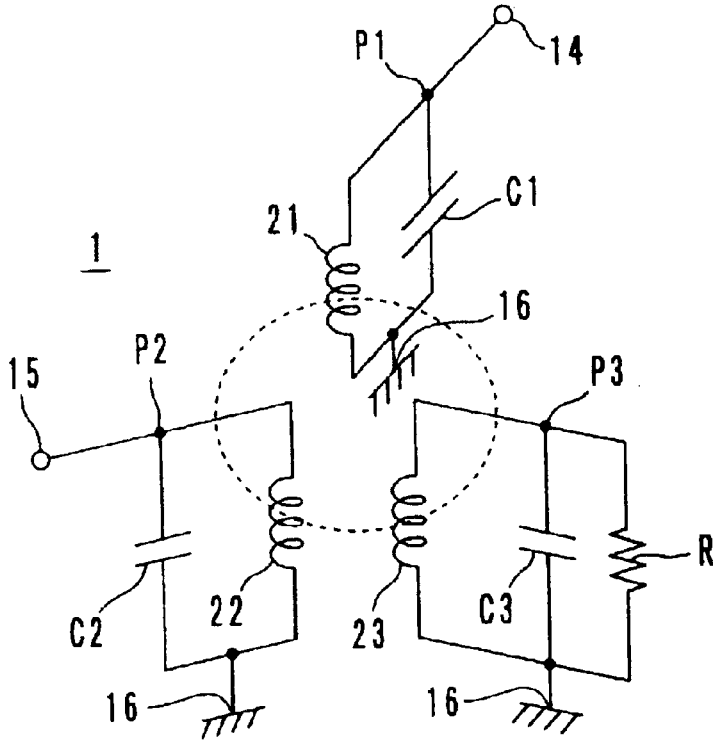
FIG. 6 is an electrical equivalent circuit diagram of the nonreciprocal circuit element shown in FIG. 5.

In this way, the isolator shown in FIG. 5 is provided. FIG. 6 is an electrical equivalent circuit diagram of the isolator shown in FIG. 5.

The above-described ground electrode plate 17 of the isolator 1 was described as one that is exposed at the substantially circular insertion hole 3*c* formed in the resin terminal case 3, and that the exposed portion thereof is used as the ground lead-out electrode 16*a*, but this is not restrictive. An arrangement in which the same hole as the insertion hole 3*c* is formed in the ground electrode plate 17 may also be adopted. In this case, the bottom wall 8*a* of the lower metallic case 8 can be seen from the insertion hole 3*c* of the resin terminal case 3. The ground electrode 24 of the center electrode assembly 13 is directly bonded to the bottom wall 8*a*. This allows the thickness of the isolator 1 to become lower by the thickness of the ground electrode plate 17, resulting in a reduced size of the isolator 1.

Figure 7:
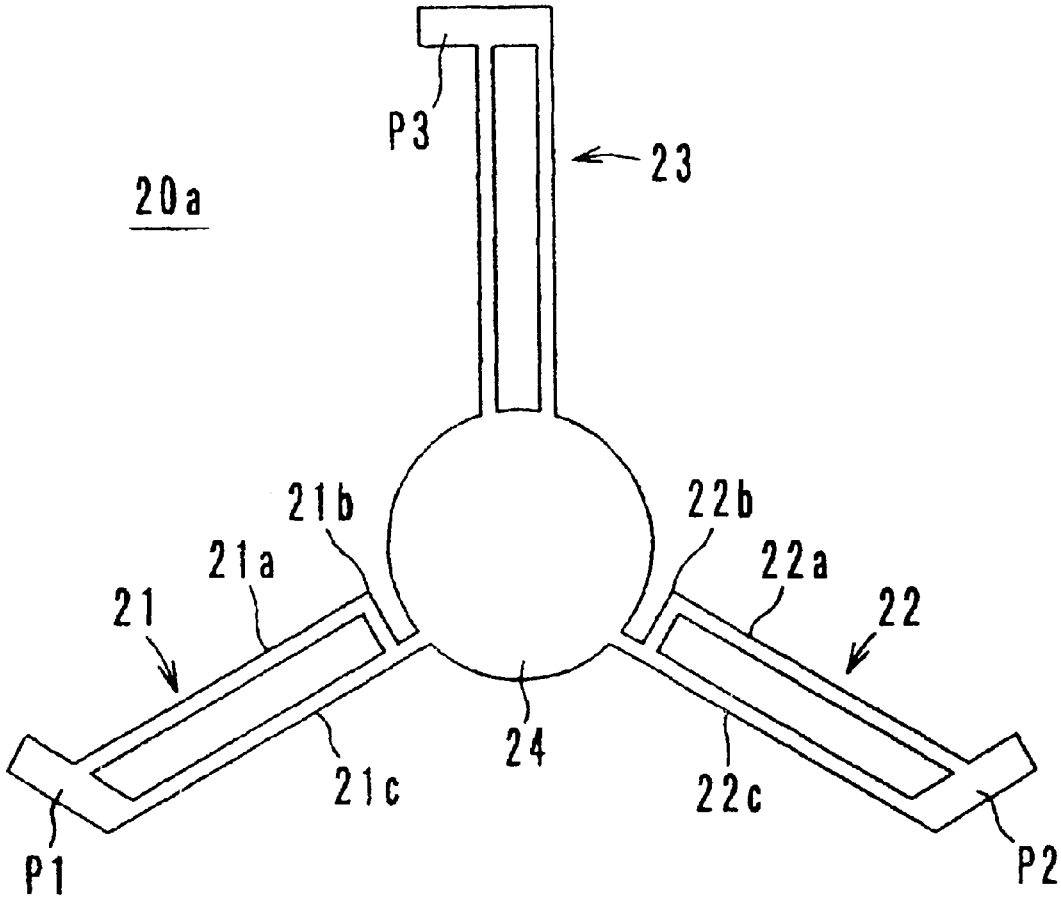
FIG. 7 is a developed view of a center conductor in a second preferred embodiment of a nonreciprocal circuit element according to the present invention.

In a second preferred embodiment of the present invention, a modification of the center conductor 20 in the above-described first preferred embodiment is shown. As illustrated in FIG. 7, in the center electrodes 21 and 22 of a center conductor 20*a*, the lines thereof on the center electrode 23 side have a corner portion 21*b* and a corner portion 22*b*, respectively, each forming substantially a right angle in the vicinity of the ground electrode 24, and the center electrode 23 side line of each of the center electrodes 21 and 22 is integrated there with the other side line thereof into one line to connect with the ground electrode 24.

Figure 8:
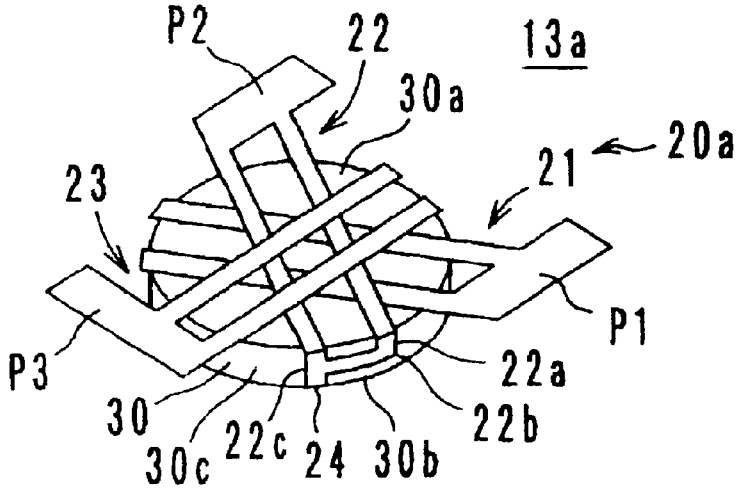
FIG. 8 is a perspective external view showing a center electrode assembly using the center conductor shown in FIG. 7.

As shown in FIG. 8, a center electrode assembly 13*a* is obtained by folding the center electrodes 21 to 23 of the center conductor 20*a*. At this time, it is preferable that the distances between the corner portions 21*b* and 22*b* of the center electrodes 21 and 22 and the ground electrode 24 are larger than the thicknesses of the matching capacitor elements C1 and C2, respectively.

The isolator 1 equipped with the above-described center electrode assembly 13*a* achieves an effect similar to that of the isolator 1 according to the above-described first preferred embodiment of the present invention.

Figure 9:
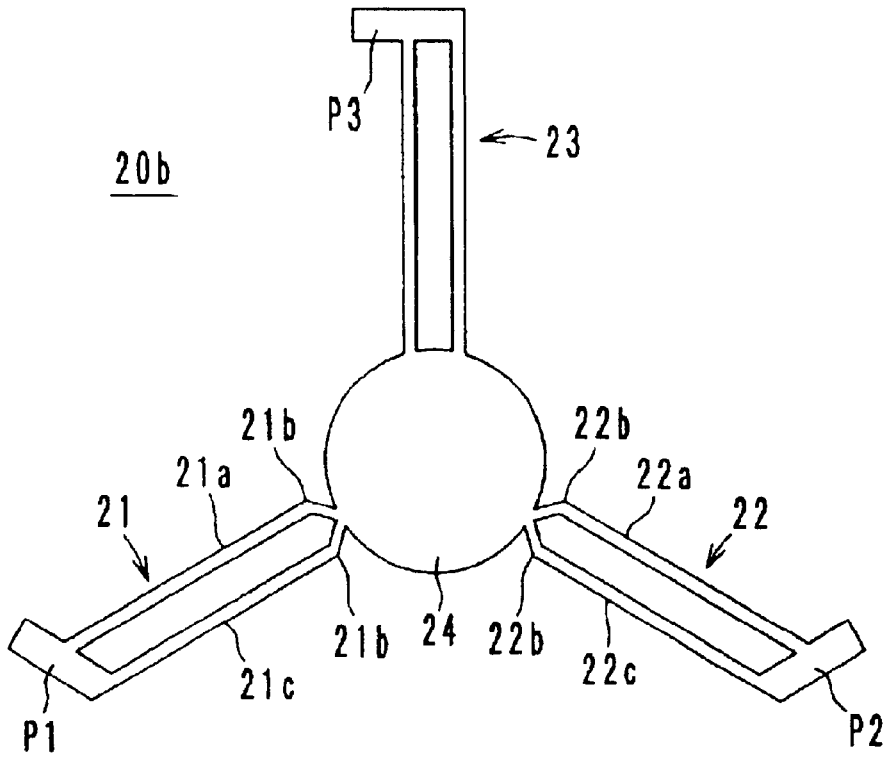
FIG. 9 is a developed view of a center conductor in a third preferred embodiment of a nonreciprocal circuit element according to the present invention.
Figure 10:
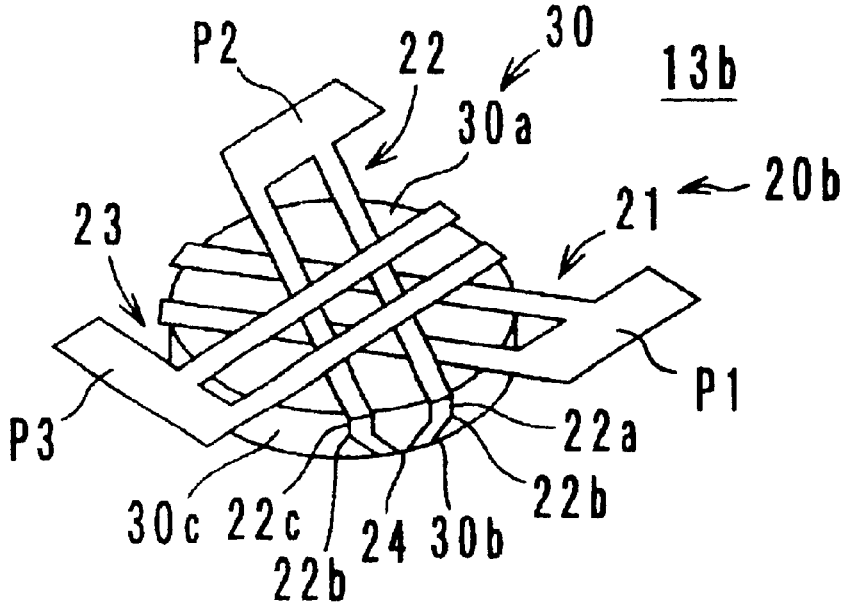
FIG. 10 is a perspective external view showing a center electrode assembly using the center conductor shown in FIG. 9.

In a third preferred embodiment of the present invention, another modification of the center conductor 20 in the above-described first preferred embodiment is shown. As illustrated in FIG. 9, in the center electrodes 21 and 22 of a center conductor 20*b*, the lines thereof on the center electrode 23 side and the other side lines thereof have a corner portion 21*b* and a corner portion 22*b*, respectively, in the vicinity of the ground electrode 24, and connect with the ground electrode 24. The lines of the center electrode 23 are connected to the ground electrode 24 substantially in parallel. In other words, the shape of each of the center electrode 21 to 23 portions disposed on the side surface 30*c* of the ferrite 30 are bilaterally symmetrical. As shown in FIG. 10, a center electrode assembly 13*b* is obtained by folding the center electrodes 21 to 23 of the center conductor 20*b* and disposing the center electrodes 21 to 23 on the top surface 30*a* of the ferrite 30.

The isolator 1 equipped with the above-described center electrode assembly 13*b* achieves an effect similar to that of the isolator 1 according to the above-described first preferred embodiment. In addition, since the bending stress to be applied in order to dispose the center electrodes 21 to 23 on the top surface 30*a* of the ferrite 30, is uniformly applied in the width directions of the center electrodes 21 to 23, the center electrode 21 to 23 can be correctly disposed on the top surface 30*a* of the ferrite 30 from the bottom surface 30*b* thereof through the side surface 30*c* thereof.

In a fourth preferred embodiment of the present invention, a modification of the center conductor 20*b* in the above-described third preferred embodiment, and a groove portions 3*f* of the resin terminal case 3 in the above-described first preferred embodiment, is shown.

Figure 11:
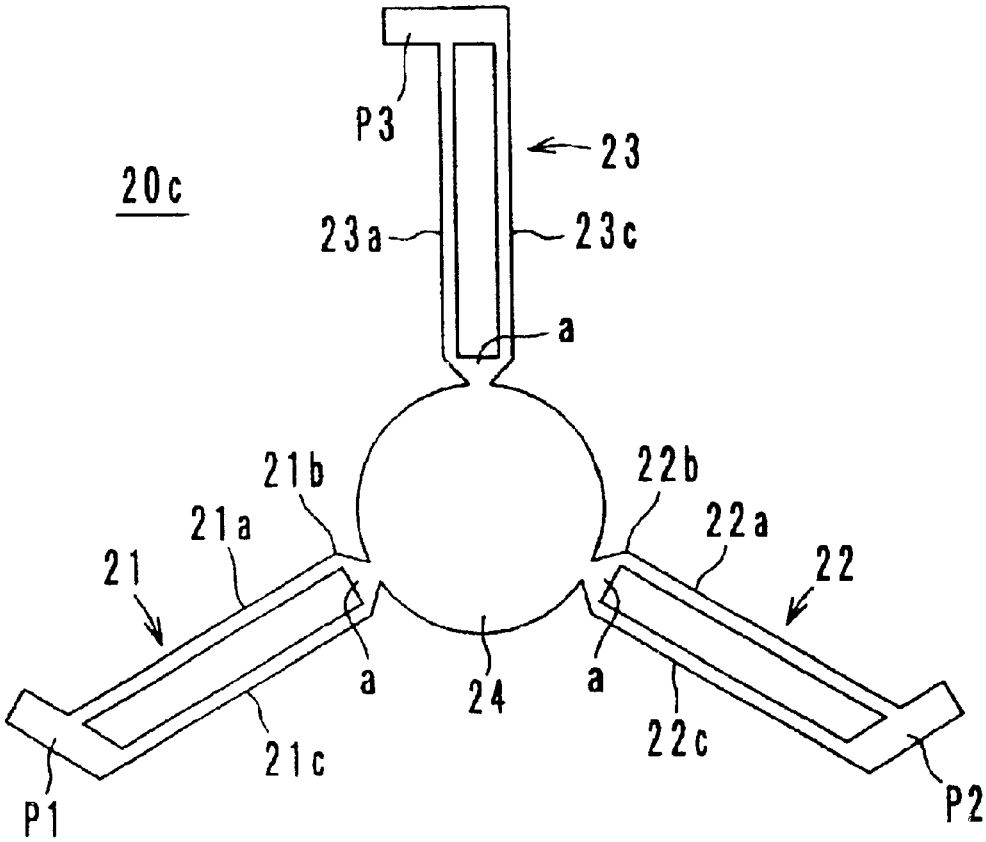
FIG. 11 is a developed view of a center conductor in a fourth preferred embodiment of a nonreciprocal circuit element according to the present invention.
Figure 12:
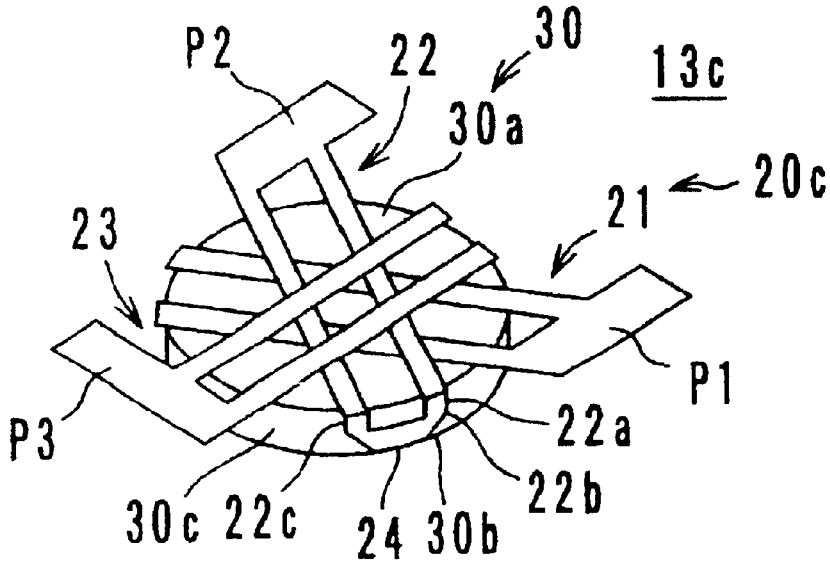
FIG. 12 is a perspective external view showing a center electrode assembly using the center conductor shown in FIG. 11.

As shown in FIG. 11, in the center electrodes 21 to 23 of a center conductor 20*c*, three sets of two opposite lines, i.e., edges 21*a* and 21*c*, edges 22*a* and 22*c*, and edges 23*a* and 23*c*, each have a corner portion in the vicinity of the ground electrode 24, and are each integrated into an inverse triangle a to join with the ground electrode 24. In particular, in the center electrodes 21 and 22 disposed on the side surface 30*c* of the ferrite 30, the bottom surface 30*b* side portion of the ferrite 30 has a taper width that is narrower than the taper width of the top surface 30*a* side portion thereof. Also, the center electrodes 21 to 23 portions disposed on the top surface 30*a* and the side surface 30*c* of the ferrite 30 each have a bilaterally symmetric shape. FIG. 12 shows a center electrode assembly 13*c* obtained by winding the center conductor 20*c* around the ferrite 30.

Figure 13:
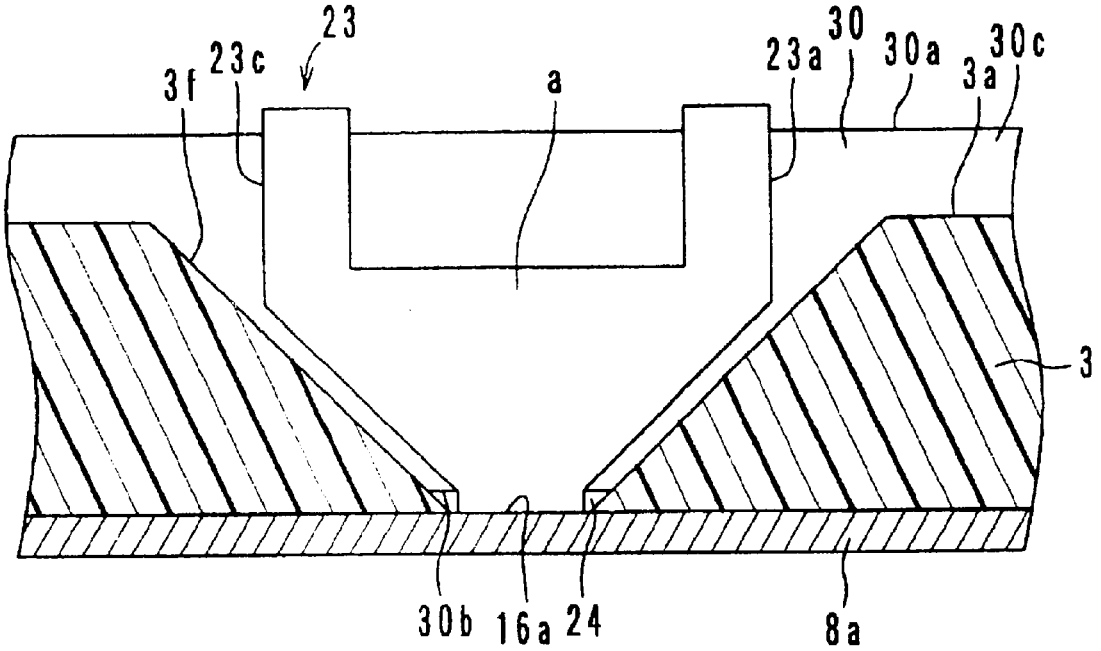
FIG. 13 is a vertical sectional view showing a nonreciprocal circuit element into which the center electrode assembly shown in FIG. 12 has been built.
Figure 14:
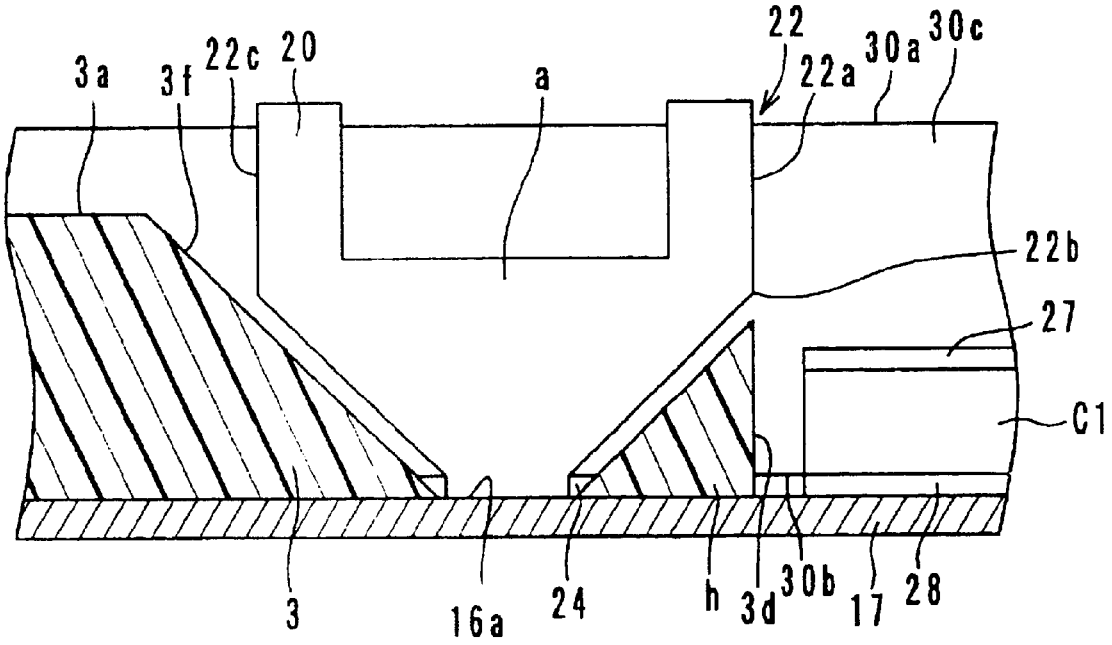
FIG. 14 is another vertical sectional view showing the nonreciprocal circuit element shown in FIG. 13.

As shown in FIGS. 13 and 14, the shape of each of the grooves 3*f* of the resin terminal case 3 has a groove shape fitted to the triangle a (taper shape) of each of the center electrodes 21 to 23. Although it is not shown in the FIGS. 13 and 14, the same goes for the center electrode 21 side portion.

The isolator 1 equipped with the above-described center electrode assembly 13*c* and the resin terminal case 3 has an effect similar to that of the isolator 1 according to the above-described first to third preferred embodiments. In addition, when the center electrode assembly 13*c* is disposed in the resin terminal case 3, the center electrodes 21 to 23 disposed on the side surface 30*c* of the ferrite 30 are smoothly fitted into the grooves 3*f*, so that the work efficiency of installing the center electrode assembly 13 in the resin terminal case is improved.

As shown in FIG. 14, a stopper portion 3*h* can be formed for forming taper shaped grooves 3*f* between the center electrode 22 disposed on the side surface 30*c* of the ferrite 30 and the capacitor electrode 27 of the matching capacitor element C1. Thereby, even if the matching capacitor element C1 experiences displacement, it is possible to secure a predetermined spacing between the center electrode 22 and the matching capacitor element C1 by virtue of the stopper portion 3*h*, thereby more reliably preventing the occurrence of short circuits. Moreover, the displacement of the center electrode assembly 13*c* is reliably prevented.

Figure 15:
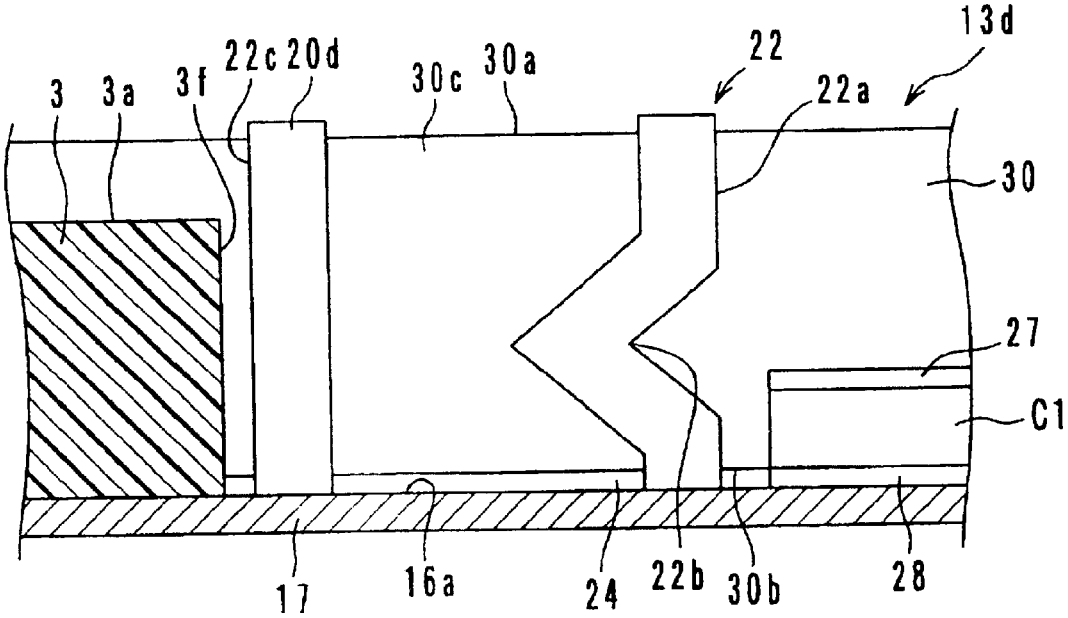
FIG. 15 is a vertical sectional view showing a fifth preferred embodiment of a nonreciprocal circuit element according to the present invention.

In a fifth preferred embodiment of the present invention, another modification of the center conductor 20 according the above-described first preferred embodiment. As shown in FIG. 15, the center electrode 22 of a center conductor 20*d* is arranged so as to circumvent the hot-side capacitor electrode 27 of the matching capacitor element C1. Specifically, an edge 22*a* of the center electrode 22*d* disposed on the side surface 30*c* of the ferrite 30 has a substantially V-shaped corner portion 22*b* at the approximate central portion between the top surface 30*a* side portion and the bottom surface 30*b* side portion. Moreover, in the direction that is substantially perpendicular to the height direction of the ferrite 30, the edge 22*a* of the center electrode 22 disposed on the side surface 30*c* of the ferrite 30 is arranged so that the substantially V-shaped corner portion 22*b* thereof is located more distant from the hot-side capacitor electrode 27 of the matching capacitor element C1 than either of the top surface 30*a* side portion and the bottom surface 30*b* side portion. Meanwhile, the shape of the center electrode 22 portion disposed on the side surface 30*c* of the ferrite 30 may be bilaterally symmetrical, and the center electrode 22 may be branched into a plurality of lines on the side surface 30*c* of the ferrite 30. Furthermore, on the side surface 30*c* of the ferrite 30, the bottom surface 30*b* side portion of the center electrode 22 may have a taper width that is narrower than the taper width of the top surface 30*a* side portion thereof. Of course, the same goes with the center electrode 21. Although it is not shown in a figure, a center electrode assembly 13*d* is obtained by winding the above-mentioned center conductor 20*d* around the ferrite 30.

The isolator 1 equipped with the above-described center electrode assembly 13*d* achieves an effect that is similar to that of the isolator 1 according to the above-described first preferred embodiment of the present invention.

In a sixth preferred embodiment of the present invention, as a communication device according to the present invention, a portable telephone will be taken as an example.

Figure 16:
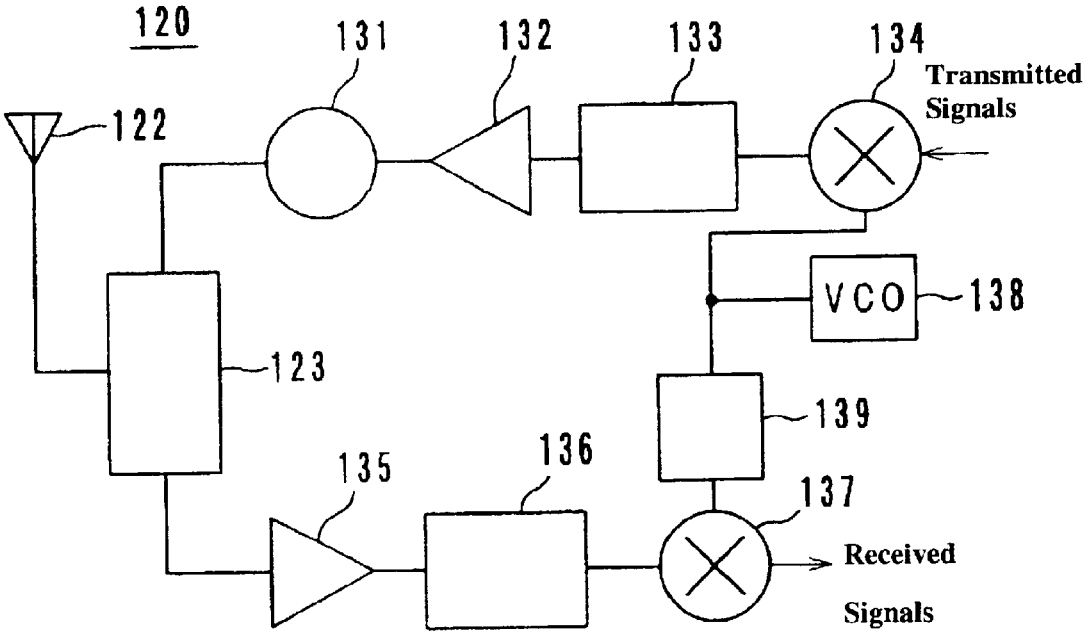
FIG. 16 is an electrical circuit block diagram of a communication device according to a preferred embodiment of the present invention.
Figure 17:
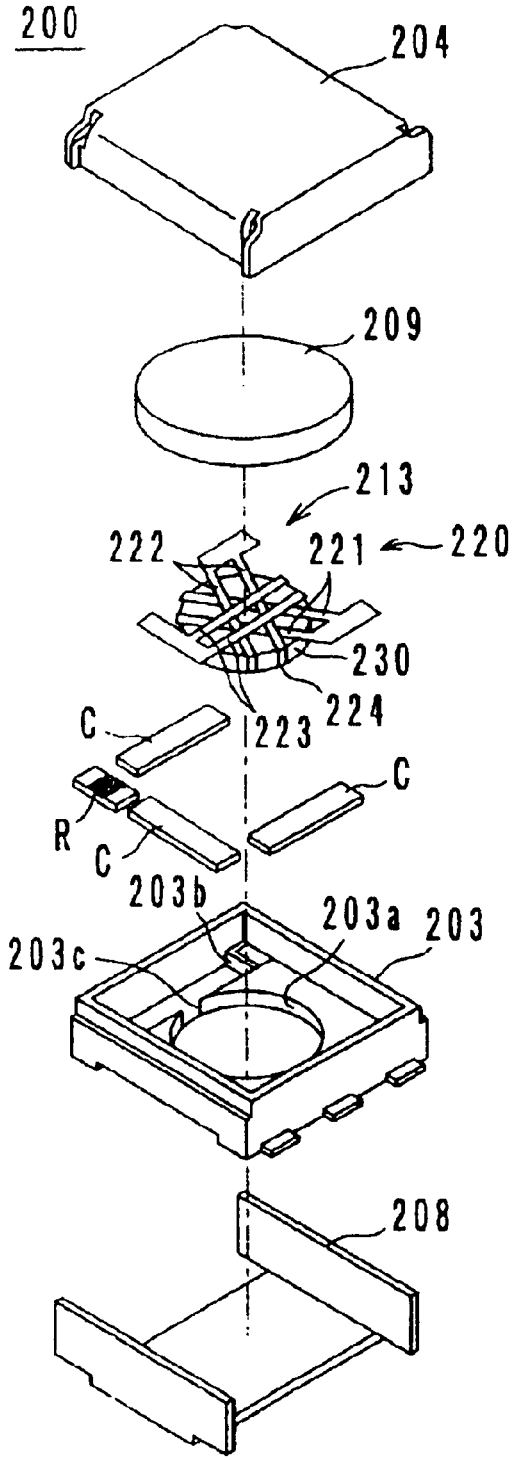
Fig. 17 PRIOR ART
FIG. 17 is a perspective exploded view showing a related nonreciprocal circuit element.
Figure 18:
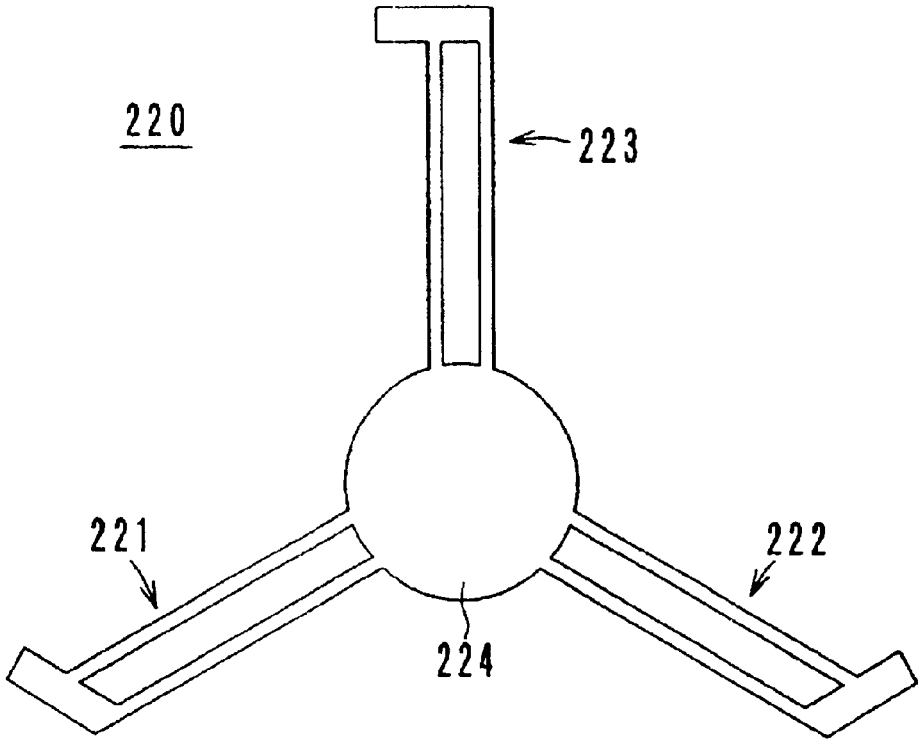
Fig. 18 PRIOR ART
FIG. 18 is a developed view showing the center conductor shown in FIG. 17.
Figure 19:
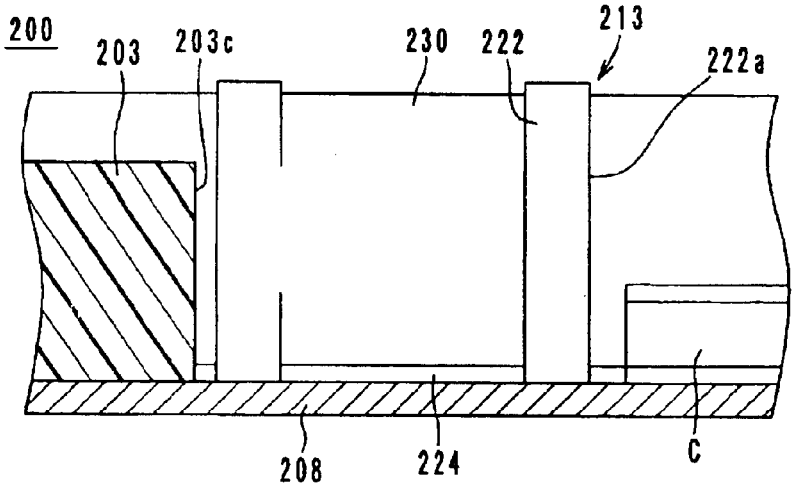
Fig. 19 PRIOR ART
FIG. 19 is a vertical sectional view showing the nonreciprocal circuit element shown in FIG. 17.

FIG. 16 is a block diagram showing the electrical circuit of the RF (Radio Frequency) portion of the portable telephone 120. In FIG. 16, reference numeral 122 designates an antenna element, reference numeral 123 a duplexer, reference numeral 131 a transmission-side isolator, reference numeral 132 a transmission-side amplifier, reference numeral 133 a transmission-side interstage band pass filter, and reference numeral 134 a transmission-side mixer. Also, reference numeral 135 designates reception-side amplifier, reference numeral 136 reception-side interstage band pass filter, reference 137 reception-side mixer, reference 138 a voltage-controlled oscillator (VCO), and reference numeral 139 a local band pass filter.

Here, as a transmission-side isolator 131, any one of the concentrated constant type isolators 1 according to the above-described first to fifth preferred embodiments can be used. Mounting this isolator 1 allows a compact and high-reliability portable telephone to be implemented.

The present invention is not limited to the above-described preferred embodiments. Various changes in configuration may be made thereto within the true spirit and scope of the present invention. For example, although the isolator 1 shown in each of the above-described first to fifth preferred embodiments was described as a three port type, the isolator 1 may instead be a two port type. Detailed structures of the components of the isolator 1, such as the upper metallic case 4, the lower metallic case 8, and the resin terminal case 3 may be optionally selected. Each of the intersection angles between the center electrodes 21 to 23 of the isolator 1 shown in the above-described first to fifth preferred embodiments was described as substantially 120 degrees, but the intersection angle is not restricted to 120 degrees. In the case of a three port type isolator, for example, the intersection angles are preferably in a range of about 90 degrees to about 150 degrees. In the case of a two port type isolator, for example, the intersection angles are preferably in a range of about 60 degrees to about 120 degrees (the representative intersection angle is substantially 90 degrees). The metallic cases were described to be constituted of two cases including the upper metallic case 4 and the lower metallic case 8, but the metallic case may instead be divided into three or more cases. Also, the shape of the ferrite 30 is not limited to a disk shape, but may be another shape such as a rectangular or a hexagon. Furthermore, the shape of the permanent magnet 9 in a plan view may be, for example, a substantially rectangular shape, and a substantially triangular shape with round corners, besides a substantially circular shape.

In the isolator 1 shown in the above-described first to fifth preferred embodiments, the one in which a terminal (not shown) electrically connected to the port P3 is newly provided besides the terminals 14 to 16 shown in FIG. 6, and in which the resistor element R is omitted, may also be used as a circulator. Moreover, the present invention can be applied to various nonreciprocal circuit elements besides isolators and circulators.

In the above-described first to fifth preferred embodiments, the number of the lines of each of the center electrodes 21 to 23 was described as two, but the number of the lines thereof is not limited to two. The number of the lines of each of the center electrodes 21 to 23 may be one, or alternatively three or more. Also, the numbers of the center electrodes 21 to 23 are not necessarily required to be equal to one another.

In the above-described sixth preferred embodiment, as a communication device, a portable telephone was taken as an example. However, the present invention can also be applied to other communication devices.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A nonreciprocal circuit element, comprising:

a permanent magnet;

a ferrite having a first main surface to which a DC magnetic field is applied by said permanent magnet, a second main surface opposed to said first main surface, and a side surface substantially perpendicularly intersecting said first and second main surfaces;

a center conductor having a ground electrode disposed on the second main surface of said ferrite, and a plurality of center electrodes that extend from said ground electrode and that are disposed so as to intersect each other at a predetermined angle on said first main surface of said ferrite through said side surface of said ferrite;

matching capacitor elements that are disposed adjacent to a center electrode assembly including said ferrite and said center conductor, and that are electrically connected to said respective center electrodes; and a metallic member that accommodates said permanent magnet and said center electrode assembly;

wherein the height of the top surface of each of said matching capacitor elements is lower than that of the first main surface of said ferrite, and on the side surface of said ferrite, one edge of at least one of said center electrodes is located closer to the electrode of the corresponding matching capacitor element than the other edge of said one of said center electrodes, and in the direction that is substantially perpendicular to the height direction of said ferrite, the second main surface side portion of said one edge of said one of said center electrodes is located more farther from the electrode of the corresponding matching capacitor element than the first main surface side portion of said one edge of said one of said center electrodes.

2. A nonreciprocal circuit element according to claim 1, wherein each of said center electrodes is branched into a plurality of lines on the side surface of said ferrite, said plurality of branched lines being disposed on the first main surface of said ferrite.

3. A nonreciprocal circuit element according to claim 1, wherein the shape of each of the center electrode portions disposed on the side surface of said ferrite is bilaterally symmetrical.

4. A nonreciprocal circuit element according to claim 1, further comprising a resin terminal member having a concave portion for accommodating said center electrode assembly and said matching capacitor elements, wherein each of said center electrodes disposed on the side surface of said ferrite is arranged so that the second main surface side portion thereof has a taper width that is narrower than a taper width of the first main surface side portion thereof, and grooves each fitted to the taper shape of said center electrode are provided in the side wall of the concave portion of said resin terminal member.

5. A nonreciprocal circuit element according to claim 1, wherein each of the matching capacitor elements includes a hot-side capacitor electrode disposed over the entire top surface thereof and a cold-side capacitor electrode disposed over the entire bottom surface thereof.

6. A nonreciprocal circuit element according to claim 1, wherein the thickness of each of the matching capacitor elements is less than the thickness of the ferrite.

7. A nonreciprocal circuit element according to claim 1, wherein a stopper portion defines taper shaped grooves between the center electrode disposed on the side surface of the ferrite and the capacitor electrode of one of the matching capacitor elements.

8. A nonreciprocal circuit element according to claim 1, wherein the nonreciprocal circuit element defines an isolator.

9. A nonreciprocal circuit element according to claim 1, wherein the predetermined angle between the center electrodes is within a range from about 60 degrees to about 90 degrees.

10. A communication device comprising a nonreciprocal circuit element according to claim 1.

11. A nonreciprocal circuit element, comprising:

a permanent magnet;

a ferrite having a first main surface to which a DC magnetic field is applied by said permanent magnet, a second main surface opposed to said first main surface, and a side surface substantially perpendicularly intersecting said first and second main surfaces;

a center conductor having a ground electrode disposed on the second main surface of said ferrite, and a plurality of center electrodes that extend from said ground electrode and that are disposed so as to intersect each other at a predetermined angle on said first main surface of said ferrite through said side surface of said ferrite;

matching capacitor elements that are disposed adjacent to a center electrode assembly including said ferrite and said center conductor, and that are electrically connected to said respective center electrodes; and a metallic member that accommodates said permanent magnet and said center electrode assembly;

wherein the height of the top surface of each of said matching capacitor elements is lower than that of the first main surface of said ferrite, and on the side surface of said ferrite, one edge of at least one of said center electrodes is located closer to the electrode of the corresponding matching capacitor element than the other edge of said one of said center electrodes, and in the direction that is substantially perpendicular to the height direction of said ferrite, the central portion between the first main surface side portion and the second main surface side portion of said one edge of said one of said center electrodes is located farther from the hot-side capacitor electrode of the corresponding matching capacitor element than either of the first main surface side portion and the second main surface side portion of said one edge of said one of said center electrodes.

12. A nonreciprocal circuit element according to claim 11, wherein each of said center electrodes is branched into a plurality of lines on the side surface of said ferrite, said plurality of branched lines being disposed on the first main surface of said ferrite.

13. A nonreciprocal circuit element according to claim 11, wherein the shape of each of the center electrode portions disposed on the side surface of said ferrite is bilaterally symmetrical.

14. A nonreciprocal circuit element according to claim 11, further comprising a resin terminal member having a concave portion for accommodating said center electrode assembly and said matching capacitor elements, wherein each of said center electrodes disposed on the side surface of said ferrite is arranged so that the second main surface side portion thereof has a taper width that is narrower than a taper width of the first main surface side portion thereof, and grooves each fitted to the taper shape of said center electrode are provided in the side wall of the concave portion of said resin terminal member.

15. A nonreciprocal circuit element according to claim 11, wherein each of the matching capacitor elements includes a hot-side capacitor electrode disposed over the entire top surface thereof and a cold-side capacitor electrode disposed over the entire bottom surface thereof.

16. A nonreciprocal circuit element according to claim 11, wherein the thickness of each of the matching capacitor elements is less than the thickness of the ferrite.

17. A nonreciprocal circuit element according to claim 11, wherein a stopper portion defines taper shaped grooves between the center electrode disposed on the side surface of the ferrite and the capacitor electrode of one of the matching capacitor elements.

18. A nonreciprocal circuit element according to claim 11, wherein the nonreciprocal circuit element defines an isolator.

19. A nonreciprocal circuit element according to claim 11, wherein the predetermined angle between the center electrodes is within a range from about 60 degrees to about 90 degrees.

20. A communication device comprising a nonreciprocal circuit element according to claim 11.

* * * * *